United States Patent [19]

Compton et al.

[11] 4,008,039

[45] Feb. 15, 1977

[54] LOW EMISSION BURNERS AND CONTROL SYSTEMS THEREFOR

[75] Inventors: William A. Compton; Thomas E. Duffy; Richard T. LeCren; Jack R. Shekleton, all of San Diego, Calif.

[73] Assignee: International Harvester Company, San Diego, Calif.

[22] Filed: May 16, 1975

[21] Appl. No.: 578,098

[52] U.S. Cl. ..... 431/90; 60/39.65; 137/88; 431/10

[51] Int. Cl.[2] ..... F23R 1/10

[58] Field of Search ..... 431/352, 10, 168, 90; 137/87, 88, 115; 251/205; 60/39.65, 39.29; 432/222

[56] References Cited

UNITED STATES PATENTS

| | | | |
|---|---|---|---|
| 548,647 | 10/1895 | Malk | 431/352 X |
| 1,549,390 | 8/1925 | Smith | 431/168 X |
| 1,699,067 | 1/1929 | Holmgren | 431/168 |
| 2,764,995 | 10/1956 | Krupp et al. | 251/205 X |
| 3,544,246 | 12/1970 | Meyer | 431/352 |
| 3,840,323 | 10/1974 | Eckerle et al. | 431/90 |

*Primary Examiner*—Edward G. Favors
*Attorney, Agent, or Firm*—Strauch, Nolan, Neale, Nies & Kurz

[57] ABSTRACT

A burner for Rankine cycle engines which includes a combustor of the rotating atomizer type and a control system therefor which keeps the ratio of fuel and air supplied to the combustor at an optimum over a wide range of operation to maximize efficiency and minimize the emission of pollutants from the combustor.

11 Claims, 6 Drawing Figures

LOW EMISSION BURNERS AND CONTROL SYSTEMS THEREFOR

This invention relates to low emission burners and, more particularly, to novel low emission burners which are particularly useful for Rankine cycle engines and to novel control systems for such burners.

The majority of the air pollutants in the atmosphere over the United States are undesirable emissions from internal combustion automotive engines. Each day automobiles, trucks, buses, etc. dump many thousands of tons of gaseous and particulate pollutants into the limited volume of air over this country.

In recent times considerable effort has been devoted to reducing pollution of the atmosphere by internal combustion engines. Alternatives which have been and are currently being explored include modifications in current internal combustion engine designs, the addition of post combustion pollution control devices, the use of cleaner burning fuels, and the substitution of other types of engines for those of the internal combustion type.

Of these alternatives, the replacement of internal combustion engines with external combustion engines in which a fossil or other fuel is burned in a combustor to heat a working fluid seems to offer the most promise. For a variety of reasons, the Rankine cycle engine is potentially the most promising of the external combustion engine candidates.

To date, however, external combustion type power plants have not begun to reach their potential. One reason has been the lack of suitable combustors and combustor control systems.

Typical prior art combustors are bulky, inefficient during transient conditions and at the limits of their operating ranges, and incapable of meeting low emission levels, especially during start-up and shutdown and under transient conditions. Other common drawbacks are cost and slowness of operation; i.e., start-up and shutdown times are often long, and large and frequent changes in power demand cannot be met.

These drawbacks are in part due to the manner in which the combustible mixture is formed and burned and the manner in which the supply of fuel and air to the combustor is controlled.

Many prior art combustors have injector systems which cannot form a spray at the low fuel flow rates encountered in applications where our novel combustors can be used to particular advantage. Other combustors can form sprays at low flow rates but only with an auxiliary, high pressure, air assist. This is undesirable because it changes the fuel-air ratio, reducing combustion efficiency and increasing the emission of pollutants.

In addition, the size of the drops into which the fuel is atomized in typical prior art combustors will typically be different at high and low fuel flows. As a consequence, combustion efficiency and emission control suffer.

Another drawback of typical prior art combustors is that the air-to-fuel ratio varies from the optimum at all but a few firing rates or even over the entire range under different conditions. This results in considerable variations in combustion efficiency and, also, in the emission of pollutants at levels which may be unacceptable. While there are air flow controls designed to eliminate such problems, those heretofore proposed are not particularly satisfactory. Variable speed blowers respond satisfactorily to changing conditions only if complex hydromechanical drives are used to vary the blower speed. Electric and belt drive controls have response and cost limitations and lack sufficient range to be satisfactory. Variable vane blowers perform well but are complex and expensive.

Systems in which the fuel and air are premixed in vapor form to form an optimum mixture also have their drawbacks. Emission levels are high during start-up and transient conditions. Rapid vaporization and uniform mixing require large mixing volumes, high air velocities, small fuel droplets, and a large heat input. The result is bulk and high parasitic power losses. Also, a flashback explosion hazard is present; and operation at low flow rates and during transient conditions can be unreliable and inefficient.

Another requirement in the forefront for automotive applications is that the power plant be capable of operating efficiently on cold days and at high altitudes. Many heretofore proposed external combustion systems do not meet this requirement because fuels become viscous in the indicated circumstances, and their fuel supply systems are not capable of efficiently atomizing viscous fuels. In many cases the problem is compounded at low firing rates because of the low flow of fuel.

We have now invented novel low emission burners which are free of the drawbacks discussed above and which otherwise have the attributes necessary for automotive and other demanding applications.

Our novel low emission burners employ can type combustors and a rotating cup fuel injection system. Fuel is directed onto the inner surface of a conical cup rotating at high speed (typically 4000 rpm or higher) and is atomized as it is moved toward and propelled off the periphery of the cup by centrifugal force. The atomized fuel is mixed with primary air in a primary flame zone adjacent the rotating cup and ignited to initiate the combustion process. Further downstream secondary air is added to the fuel, and the combustion process approaches completion in this secondary flame zone. Still further downstream from the rotating cup is a tertiary flame zone. Here additional air can be added to reduce the combustion products to a temperature at which they can safely be used to operate a steam generator, for example.

The rotating cup fuel injectors we employ in our novel combustors are reliable and inexpensive; and, furthermore, only simple, low cost fuel pumps and ignition systems are needed. There are no small orifices in a rotating cup injector; and, accordingly, plugging is not a problem as it is to varying degrees in Diesel and gas turbine engine injection systems and in gasoline carburetors.

At the same time precise control over drop size is afforded because drop size is essentially a function only of the cup speed. This is important in achieving maximum combustion efficiency and emission control.

The injector remains efficient over a wide range of fuel flows with no deterioration in spray quality or variation in spray angle because these factors are, essentially, dependent only on the angle of the cup. The operation of the injectors we employ are, furthermore, independent of changes in fuel viscosity within wide limits.

The fuel is supplied to the rotating cup injector through a novel metering valve having a flow area that can be continuously varied between maximum and minimum limits varying by a ratio of 100:1 or more, making our novel combustors capable of being operated on a modulating as opposed to on-off basis. This avoids the considerable increase in emissions which accompanies the frequent start-up and shutdown needed to provide a variable output in an on-off type of device.

That our novel combustors have a turndown ratio of 100:1 is not only highly advantageous in the applications for which they are particularly intended but possibly unique. At the present state-of-the-art even turndown ratios of 15 to 1 are difficult to obtain.

Air is supplied to the combustor of our novel low emission burners through a second metering valve which is mechanically coupled to the fuel metering valve. As a result the ratio of air and fuel flow areas can be accurately related in a programmed fashion over the entire range of operation of the system.

A novel $\Delta P$ regulator keeps the pressure drop across the fuel metering valve proportional to the pressure drop across the air metering valve over the entire fuel flow range, ensuring that the fuel-air ratio remains a function of the metering valve flow areas. This makes it possible, in our novel low emission burners, to maintain a programmed fuel-to-air ratio over the entire fuel flow range. The result is high efficiency and low emissions over the entire range of burner operation.

Furthermore, because of the novel control system just described, our novel burners have a response which is sufficiently rapid to keep steam pressures and temperatures in an engine in which the combustor is incorporated within safe limits during rapid load reductions and to virtually eliminate control system attributable transient delays, thus promoting the quick response to rapid load increases necessary for safe operation in highway passing situations and the large changes in fuel flow rate at frequent intervals necessary for satisfactory automobile operation in city traffic.

Typically, any given power level can be arrived at from any other power level in one second or less. Furthermore, firing rate changes of this magnitude can be made without exceeding permissible emission levels on a time averaged basis.

Upon start-up, 75 percent of the maximum output can typically be attained within 1 second and close to 100 percent of the maximum within 3 seconds. Shutdown from any firing rate can be effected in approximately one second.

Start-ups and shutdowns are clean. Emissions during start-up will typically not be more than twice those in steady state operation, and those maximums will typically not be exceeded for more than 30 seconds. Increases during even the most rapid shutdowns are negligible.

Yet another feature of our novel low emission burners is the control system we employ. Our novel control systems are capable of automatically compensating for temperature and altitude changes, blower speed variations, reductions in blower efficiency attributable to fouling and wear, and system leakage. These systems similarly compensate for variations caused by back pressure on the fuel flowing to the combustor and by changes in combustor chamber pressure. They also eliminate the variations that would otherwise occur as the load changes and the output of the combustion air blower or fan changes in response.

Another advantage of our novel low emission burners is compactness. For example, a burner capable of generating as many as 2 million BTU per hour may occupy a volume less than 1⅓ cubic feet including fan, ducting, and insulation. The actual combustor volume may be only 0.5 cubic feet.

A related and also important advantage is that the volume of the combustor can be readily adjusted, if desired. For example, in some applications, it may prove desirable to increase the combustor volume and thereby provide more radiant surface for heat redistribution. Or, combustor volume can be readily adjusted as dictated by boiler design, permissible pollutant emission levels, permissible noise levels, etc.

As indicated previously, low pollution levels are also an important advantage and feature of our novel burners. Typical maximum levels at which pollutants will be released into the surrounding atmosphere during steady state operation are:

| Pollutant | Grams per kilogram of fuel |
|---|---|
| Carbon monoxide | 5.0 |
| Unburned hydrocarbons | 1.1 |
| Nitrogen oxides | 2.5 |
| Smoke | None visible |
| Odor | Undetectable by humans |

Emissions can be kept below these low levels over a wide temperature range and a wide range of altitudes — typically, −65° to 130° F. and sea level to 12,000 feet.

That such low emission levels are attained is in part due to the relatively low maximum flame temperatures reached in the combustors of our novel low emission burners ( $\leq$ 3000° F.) and to the initial combustion of the fuel-air mixture in a fuel-rich zone.

The ability of our novel burners to operate below the emission levels tabulated above can be appreciated by remembering that emissions of carbon monoxide are proportional to fuel flow and inversely proportional to combustor volume and flame temperature while nitrogen oxide emissions are directly proportional to combustor volume and flame temperature and inversely proportional to fuel flow. That we can reach the low emission levels indicated above is clear evidence that these seemingly contradictory requirements are harmonized in our low emission burners.

Yet another advantage of our novel low emission burners in those applications where they are used in conjunction with a steam generator is that the gases supplied to the boiler are free of hot and cold streaks. This is important because distortion and burn out of the boiler components are thereby avoided. In a typical application a burner constructed in accord with the principles of our invention will be capable of supplying gases to the boiler at a temperature of 2500° F. with a maximum variation of ± 300° F.

Another advantage of our invention is that a variety of boilers or vapor generators can be employed. Aside from the size, weight, cost, etc., essentially the only limitation is that the design be one which will not adversely modify the character of the flame generated in the combustor of the burner.

Other important advantages of our novel low emission burners are that they can be operated on a variety of fuels and that high combustion efficiencies (up to 99+ percent in steady state operation) can be attained over the entire operating range of the burner.

A further important advantage of our novel low emission burners is that parasitic power losses are low. In a typical application air and fuel pumping and ignition power requirements may be less than 1.5 horsepower for a 2,000,000 BTU per hour burner.

Still other important advantages of our novel low emission burners are that they have a minimum number of components and high reliablility, use components capable of being mass produced at low cost, have a long service interval (e.g., 25,000 miles in automotive and similar applications), and can be serviced by persons not conversant with the system in a minimum amount of time. Our novel burners are fail safe in that failure of one component will not result in damage to other components, and they have a long service life (typically 100,000 miles in automotive applications) and can be made acceptably quiet.

From the foregoing it will be apparent to the reader that one important object of the present invention resides in the provision of novel, improved low emission burners which are particularly suited for automotive and other demanding applications.

Another important and primary object of the invention resides in the provision of novel, improved systems for controlling the flow of fuel and air to the combustors of low emission burners as described above.

Other important but more specific objects of the invention reside in the provision of novel, improved low emission burners:

(1) which are compact;

(2) which have a relatively small number of components that lend themselves to manufacture by mass production techniques;

(3) which have low pollutant emission levels, even during start-up and shutdown and under other transient conditions;

(4) which operate efficiently over a wide range of power outputs and over a wide range of ambient conditions:

(5) which are capable of providing full power rapidly after start-up and of responding rapidly to large and frequent changes in demand;

(6) which can be operated on a variety of fuels;

(7) which have low parasitic power losses;

(8) which are reliable, have a long service life, and can be serviced in a minimum amount of time by persons not conversant with their details.

Still other important objects of the invention reside in the provision of novel, improved systems for supplying fuel and air to the combustor of a burner and for controlling the supply of fuel and air:

(9) which are capable of providing a modulated type of operation over a wide turndown range;

(10) which are capable of maintaining a controlled ratio of fuel to air over an entire, large range of fuel flow rates;

(11) which employ a fuel injector capable of maintaining a constant fuel distribution pattern and drop size over a wide range of fuel flow rates;

(12) which employ a fuel injector that is not subject to clogging and similar problems;

(13) which are capable of automatically compensating for changes in altitude and ambient temperature;

(14) which require only simple and inexpensive fuel pumps and ignition systems;

(15) which are capable of automatically correcting for blower speed changes, reductions in blower efficiency, air leakage, back pressure in the fuel line, changes in combustor pressure, and the like;

(16) which ensure that safe operating conditions will not be exceeded under even the most extreme conditions.

Other objects and features and further advantages of our invention will become apparent from the appended claims and as the ensuing detailed description and discussion proceeds in conjunction with the accompanying drawing, in which:

Figure 1:
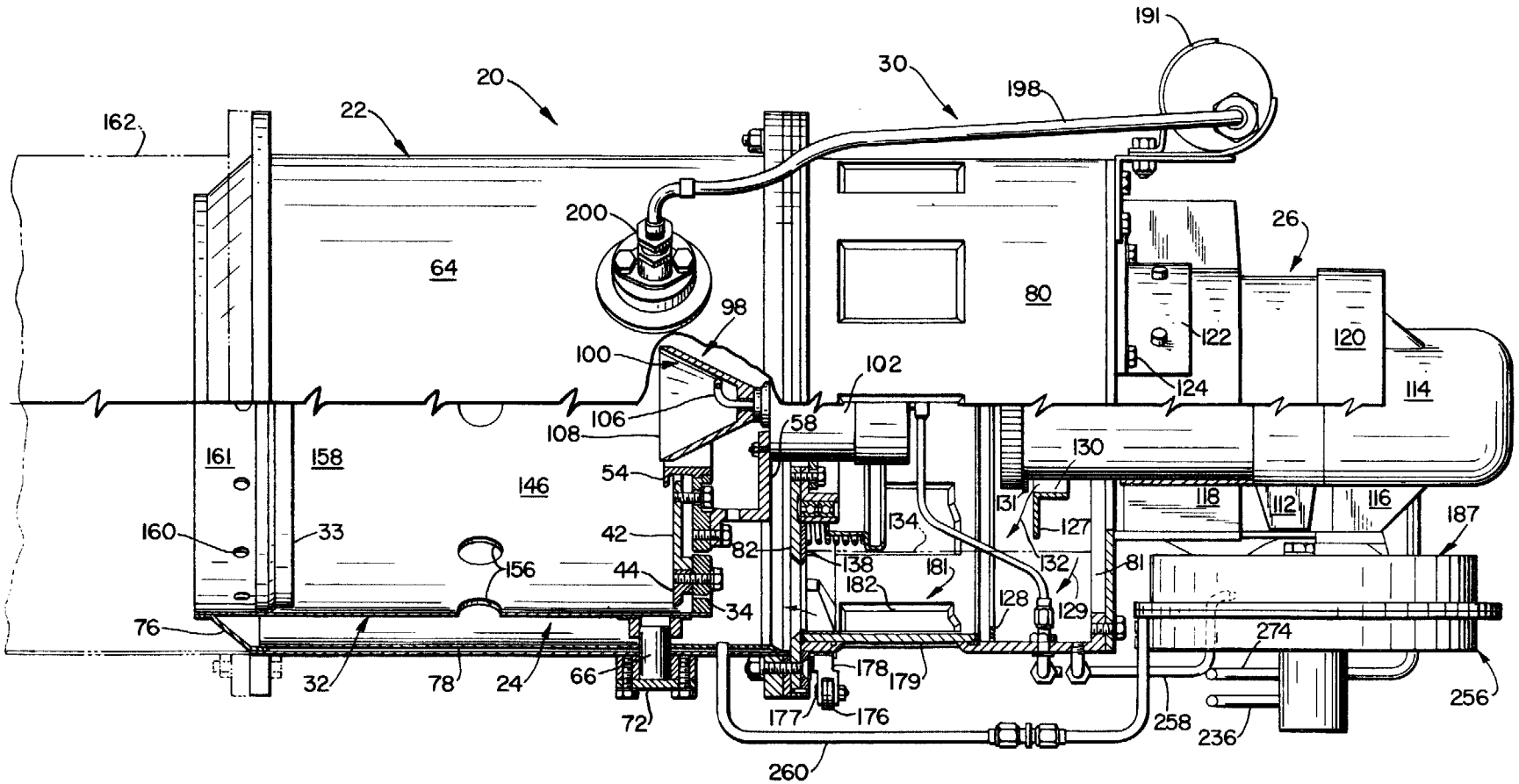
FIG. 1 is a partly sectioned side view through a low emission burner in accord with the principles of the present invention.
Figure 2:
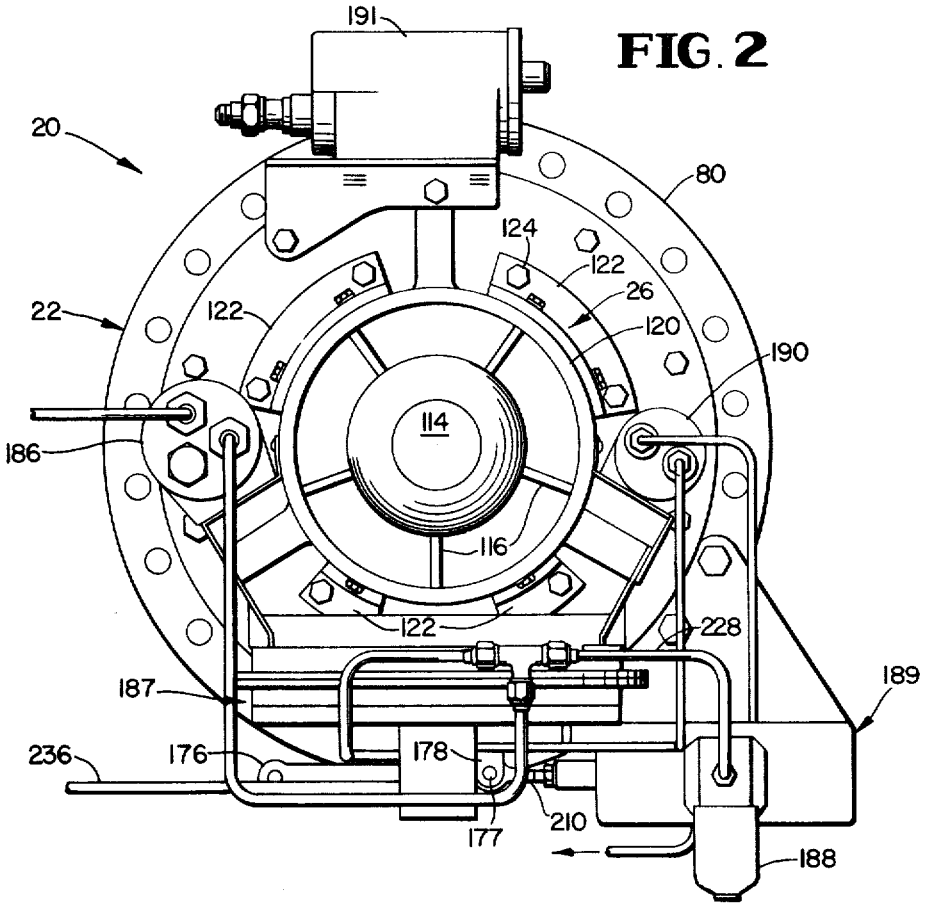
FIG. 2 is an end view of the burner.
Figure 4:
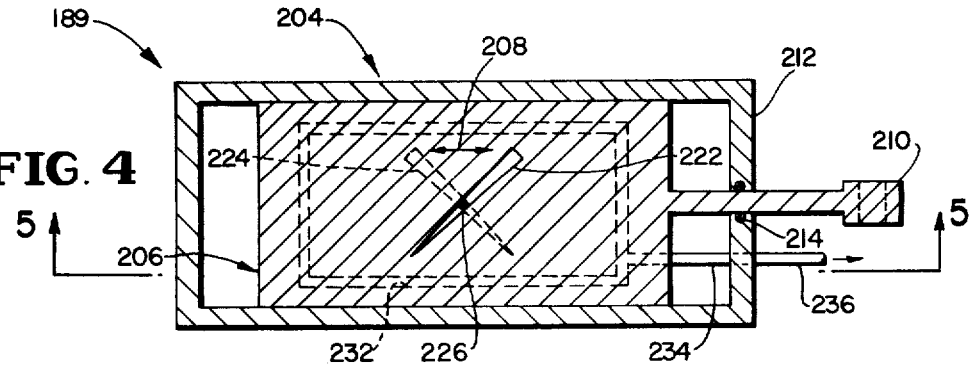
FIG. 4 is a section through a metering valve employed in the control system of FIG. 3.
Figure 5:
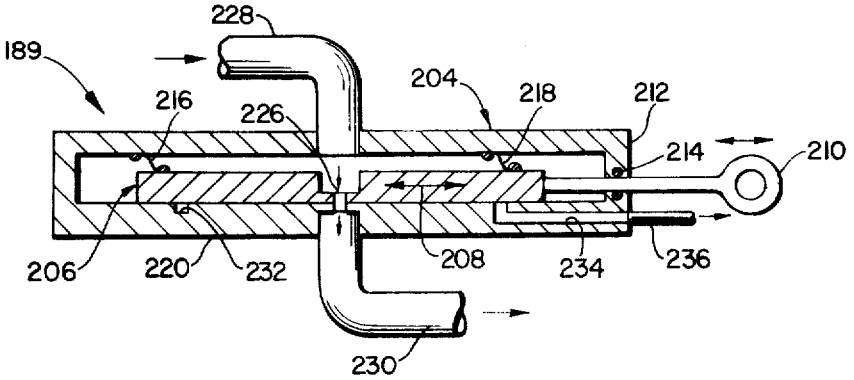
Figure 3:
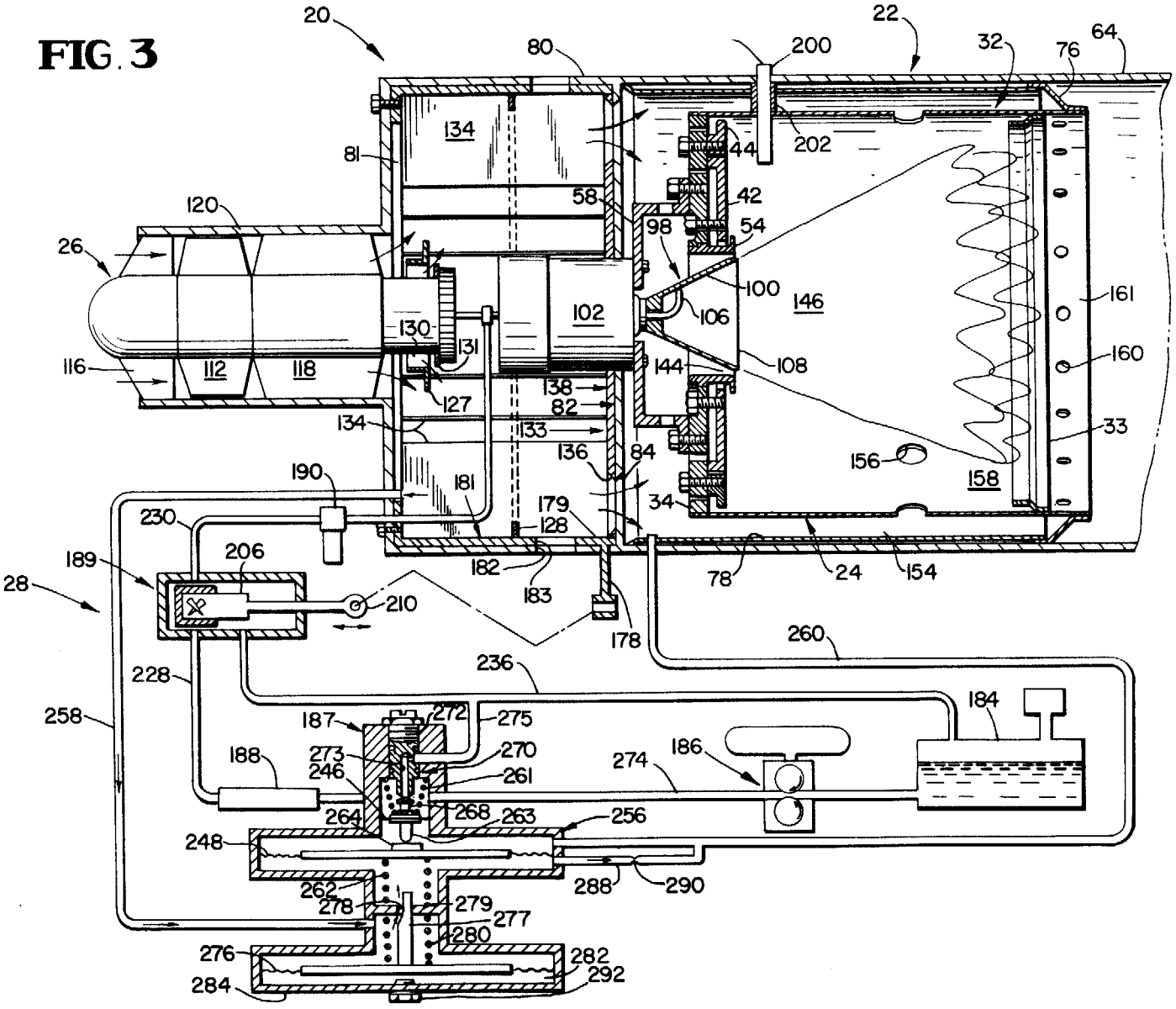
FIG. 3 is a schematic illustration of a control system for the burner of FIG. 1.
Figure 6:
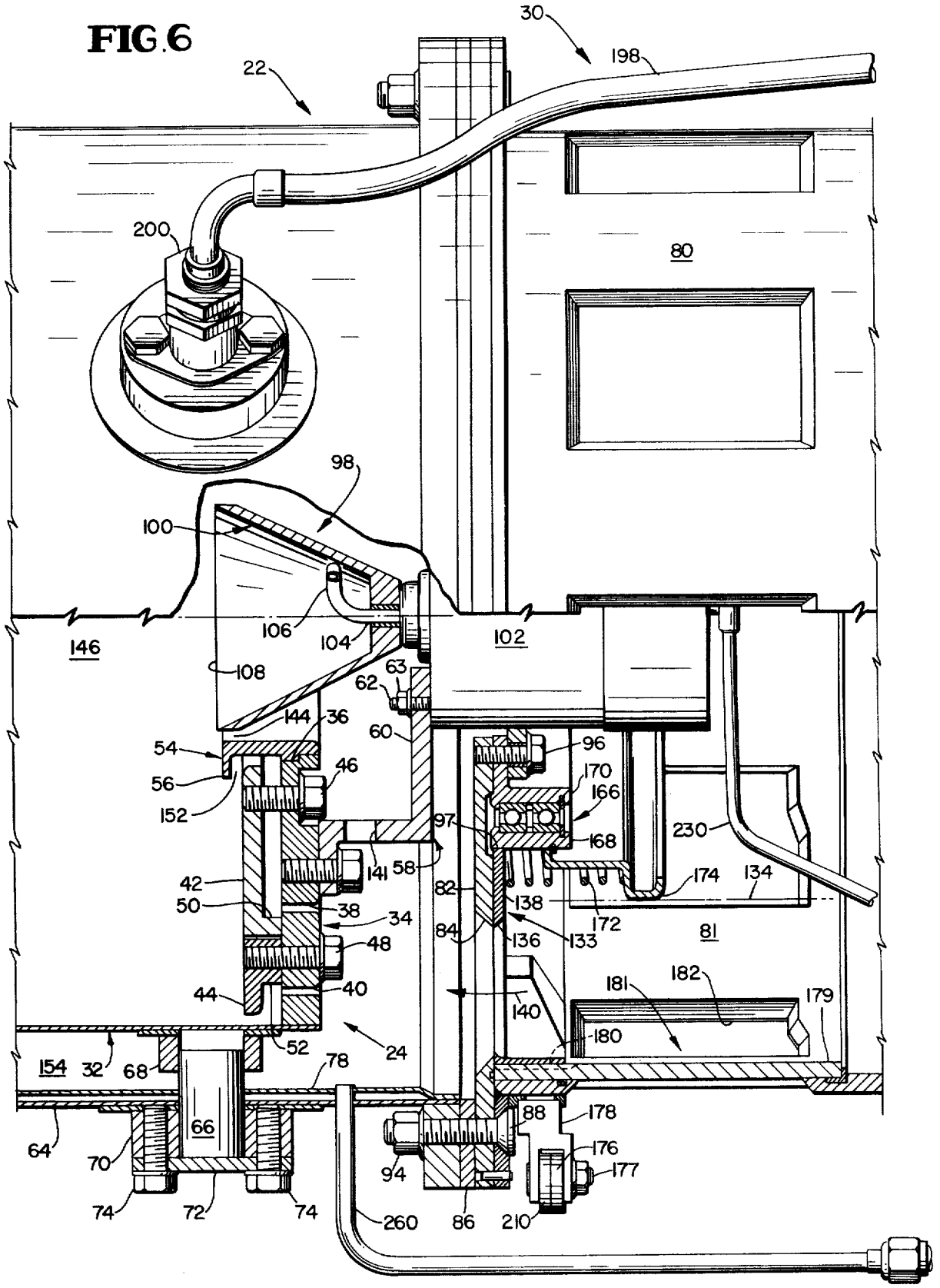

FIG. 5 is a section through the metering valve, taken substantially along line 5—5 of FIG. 4; and FIG. 6 is a fragment of FIG. 1 to alarger scale. a larger Referring now to the drawing, FIGS. 1–3 depict a low emission burner 20 embodying and constructed in accord with the principles of the present invention. The main components of the burner include a cylindrical casing 22 housing a combustor 24, a blower 26 for supplying air to the combustor, a novel system 28 for supplying fuel and controlling the flow of air and fuel to the combustor, and an ignition system 30.

As best shown in FIGS. 1 and 6, combustor 24 includes a cylindrical casing 32 with an annular cooling strip 33 in its rear or exhaust end. Fixed in the front end of the casing is a rear combustion dome 34. This component is a circular, platelike member with a central opening 36 and two, radially spaced, series of air flow apertures or orifices 38 and 40.

Inner and outer front combustion domes 42 and 44 of annular, plate and ringlike configuration, respectively, are fixed to the rear combustion dome by fasteners 46 and 48. An annular flange 50 on the inner dome and a similar flange 52 on the outer dome space front domes 42 and 44 from rear dome 34.

A cylindrical dome filmer 54 with an outwardly extending, radial flange 56 is mounted in any convenient manner in the central opening 36 of rear dome 34 with flange 56 spaced from the inner front dome 42.

Also attached to the rear combustion dome 34 is a swirler 58. This component has a radial flange 60 through which fasteners 62 extend to secure it in place in co-operation with retainers 63.

The front end of combustor 24 is supported in the front section 64 of casing 22 by radially extending pins 66 disposed at intervals around the combustor. Pins 66 are slidably mounted in bosses 68 and 70 fixed to the exterior of combustor casing 32 and burner casing member 64, respectively, to accommodate radial expansion of the combustor casing. Covers 72, fixed to bosses 70 as by fasteners 74, keep the pins in place and afford the access needed to install and remove them.

At its rear end, combustor 24 is supported from the outer casing 22 of the burner by a circular, rear seal 76. The Z-section of the seal permits the combustor casing to move longitudinally as its temperature changes.

Combustor casing 32 is surrounded by a cylindrical heat shield 78 fixed in any convenient manner to the outer casing 22 of the burner. This shield reduces heat losses from the combustor and, also, helps to keep the exterior burner temperature at an acceptable level.

At the front end of casing section 64 is a casing section 80 which forms a plenum 81 for combustion air supplied to the burner. This casing section, a circular flow plate 82 in which an annular series of flow apertures 84 is formed, and an annular seal 86 are assembled to casing section 64 by fasteners 88 and by retainers 94 threaded on the fasteners.

Fixed to flow plate 82 as by fasteners 96 and extending through a central aperture 97 in the plate is a rotating cup type fuel injector 98. The injector includes a conically shaped cup 100 rotatably fixed to the output shaft of an electric motor 102 and a fuel tube 104 extending through and along the axial centerline of the motor. The fuel tube terminates in a radially extending section 106 having an outlet adjacent the inner surface of the rotating cup at its narrower, front end.

Liquid fuel (e.g., gasolene, kerosene, jet fuel, etc.) is discharged onto the inner surface of rotating cup 100 from tube 104, spread into a film, and moved toward the rear edge 108 of the cup by centrifugal force. As the liquid is propelled from the rear edge of the cup, it is broken into drops. Because the speed of rotation and geometry of the cup are not dependent upon the rate at which fuel is supplied to it, the size of the drops into which the fuel is atomized and the pattern in which they are distributed into the combustor remain the same over variations in fuel flow as great as 100 to 1 or higher.

Air for the combustion process is supplied by blower or fan 26 which has blades 112 driven by a second electric motor 114. The fan and motor, together with air straighteners 116 on the upstream side of the fan and longitudinally extending, radial vanes 118 on its outlet side, are housed in a casing 120. The casing is fixed by brackets 122 and fasteners 124 to the rear end of burner casing section 80.

Combustion air exiting from vanes 118 flows around longitudinally spaced, radial baffles 127 and 128 in plenum chamber 81 as shown by arrows 129 in FIG. 1, also, through a passage 130 over a third radial baffle 131 as shown by arrows 132. The baffles reduce the dynamic head of the air discharged from blower 26, making possible linear operation of a valve 133 through which the air is metered to the combustor.

Longitudinally extending vanes 134 are located in the plenum chamber to reduce swirl and promote even distribution of the air to the combustor.

From plenum chamber 81, the combustion air flows through apertures 136 in an air metering valve member 138 and apertures 84 in stationary flow plate 82 and into casing section 64 as shown by arrow 140. From here, a part of the air flows through apertures 141 into swirler 58 where velocity components that will promote mixing of the fuel and air are imparted to the air. This air then flows through an annular passage 144 between dome filmer 54 and rotating cup 100 of injector 98 into a primary flame zone 146 where the combustible fuel-air mixture is formed and ignited.

Air also flows through the orifices 38 in rear combustion dome 34, between the latter and the inner, front combustion dome 42, and through a gap 152 between the front dome and dome filmer 54 into the combustor. The dome filmer directs this air across the surfaces of the front combustion domes to protect them from overheating.

A third part of the air flows through the orifices 40 in the rear combustion dome and around the outer, front combustor dome 44. The dome directs the air along the inner surface of combustor casing 32 to keep the casing from overheating.

The air supplied to primary combustion zone 146 in the manner just described is purposely maintained well below the level needed to complete the combustion of the fuel introduced into the combustor. This minimizes the formation of nitrogen oxides as the fuel burns. In one exemplary combustor, for example, only 15.7 percent of the air supplied to the combustor is introduced through the passage surrounding the rotating cup, and only 14.7 percent is introduced as film air.

The remainder of the combustion air flows through the annular passage 154 between combustor casing member 32 and burner casing member 64 toward the rear end of the burner. A part of this air (27.5 percent of the total in the exemplary combustor mentioned above) is diverted through orifices 156 in the combustor casing member into secondary flame zone 158 where the combustion process is essentially completed.

Additional air (14.7 percent of the total in the exemplary combustor) is introduced into the secondary flame zone through orifices 160 at the downstream or rear end of this zone.

Because of the rapidity with which the combustion process is completed and the relatively low temperatures which are maintained in the secondary combustion zone, the formation of nitrogen oxides is minimized despite the increase in the oxygen concentration. At the same time the increase in oxygen concentration promotes reductions in carbon monoxide and in unburned hydrocarbons.

The remaining combustion air (27.5 percent) is introduced into a tertiary flame zone 161 through orifices 160. This air dilutes the combustion products, reducing them to a temperature at which they can be safely used to operate a steam or other vapor generator, for example.

As indicated above, one of the advantages of our invention is that a variety of vapor generators may be employed. For this reason and because the details of the vapor generator or other heat user are not part of the present invention, the latter will not be described herein except to point out that it would be mounted in a casing 162 attached to the downstream or rear end of burner casing section 64 as shown in FIG. 1.

Referring now to FIGS. 1, 3, and 6, one of the important features of the present invention is the valve 133 through which air is metered to combustor 24. This valve includes the stationary, apertured flow plate 82 and the valve member 138 mentioned earlier. The valve member is a circular plate rotatably mounted adjacent and in sliding contact with stationary plate 82 by a ball bearing 166. The valve is fixed in any convenient manner to the outer race 168 of the bearing, and the inner race 170 is fixed to the stationary flow plate 82 by fasteners 96.

The apertures 136 in valve member 138 match the apertures 84 in the flow plate. Accordingly, by rotating the valve member relative to the stationary flow plate, the apertures 136 and 84 in these two components can be made to register to an extent which will provide maximum flow area through the valve or any smaller flow area which may be appropriate for the demand upon burner 20 down to the minimum area at which the amount of air necessary to insure efficient combustion and low emissions at the lowest fuel flow rate will be supplied to the combustor.

The apertures 136 and 84 can be configured to make the flow of air to combustor 24 linearly proportional to the rate of fuel flow over the entire range of operation. Alternatively, the apertures can be configured so that there will be one fuel-air ratio over part of the operating range and a second ratio over the remainder of the range, for example.

Valve member 138 is maintained in contact with the stationary plate 82 to minimize the leakage of air into the combustor section to a level determined by the finish on and flatness of the mating surfaces by the pressure differential across the valve and by a spring 172. The spring surrounds bearing 166 and extends from valve member 138 to a fitting 174. The fitting is mounted over the outer race 168 of bearing 166 and secured in place by a retaining ring (not shown) fitted in a groove in race 168.

The output from burner 20 is controlled by a power lever 176 fixed by a pivot pin 177 to a valve actuator 178. The actuator extends through exterior casing member 80 and is fixed to a cylindrical bypass valve member 179 in contact with and rotatably slidable in casing member 80. The bypass valve member and metering valve 133 are coupled by splines identified generally by reference character 180 in FIG. 1 and, accordingly, rotate together.

Displacement of the power lever consequently rotates metering valve member 138 via bypass valve member 179 to change the metering valve flow area as the demand upon burner 20 changes.

To keep the weight rate of flow of air to the combustor proportional to the flow area through metering valve 133 over the entire air flow range the pressure drop across the metering valve must be kept constant. This function is performed by an air bypass valve 181 made up of bypass valve member 179 and burner casing member 80.

More specifically, as the demand upon the burner is decreased, the back pressure on the combustion air blower is reduced; and its output increases. The bypass valve accommodates the increase by providing a path via which air in excess of that required to maintain the desired pressure drop across the metering valve (typically on the order of two inches of water) can be exhausted from plenum 81 into the surrounding environment.

As shown in FIGS. 1, 3, and 6, an annular series of apertures 182 is formed in the casing member 80 defining plenum 81; and matching apertures 183 are formed in valve member 179. Accordingly, when, and to the extent that, the two sets of apertures are in registry, the output from blower 26 will be discharged through the bypass valve.

Valve 181 acts in opposition to valve 133. That is, with metering valve apertures 136 and 84 in full registry to provide the maximum flow area, bypass apertures 182 and 183 are out of registry; and no air is bypassed. As the power lever is moved toward a lower setting, decreasing the demand for combustion air, apertures 136 and 84 begin to move out of registry, decreasing the flow area through the metering valve; and apertures 182 and 183 begin to move into registry. A part of the combustion air blower output is therefore discharged through the bypass valve to keep the pressure drop across the air metering valve constant, and the weight rate of the flow of air to combustor 24 is thereby reduced to a level appropriate to the lower power setting as determined by the metering valve flow area.

The system by which the liquid fuel is supplied to combustor 24 is also an important part of our novel burners. The fuel is pumped from a conventional vented tank 184 by a positive displacement fuel pump 186 through a ΔP regulator 187, a filter 188, a fuel metering valve 189, and a solenoid type, fuel shut off valve 190 into the tube 104 of fuel injector 98. Valves 189 and 190, fuel pump 186, and ΔP regulator 187 are mounted on the front or blower end of casing member 80 as shown in FIG. 2. The details of the various brackets supporting these components are not important as far as the present invention is concerned and will accordingly not be described herein.

As discussed above, fuel injector 98 atomizes the liquid fuel and propels it in a selected pattern into primary flame zone 146. Here, the fuel is mixed with the combustion air supplied as described above and ignited by the ignition mechanism 30. The latter is conventional and will not be discussed in detail herein.

Briefly, however, this mechanism includes a conventional exciter 191 fixed to the rear end of burner casing section 80 above blower 26. The exciter, operated from a battery or other electrical power source (not shown), is connected by lead 198 to a conventional igniter 200. The latter is fixed to exterior casing member 64 and extends through the latter, a cylindrical spacer 202 (see FIG. 3), and combustor casing member 32 into primary flame zone 146.

The valve 189 which meters the flow of fuel to combustor 24 in the system described above is an important part of the invention because it provides accurate control over the flow of fuel through the unusually large 100 to 1 turndown ratio. This permits operation in the preferred modulating as opposed to on-off mode, promotes high efficiency and low emissions, and makes our novel low emission burners capable of responding to large and frequent changes in demand.

As best shown in FIGS. 4 and 5, valve 189 includes a casing 204 in which a platelike valve member 206 is mounted for rectilinear movement along the path indicated by double headed arrow 208. An actuator 210, fixed to the valve member, extends through an end wall 212 of the casing. leakage through end wall 212 around the actuator is inhibited by a seal 214.

Springs 216 and 218 bias valve member 206 against the flat bottom wall 220 of the valve casing which cooperates with the valve member to meter the fuel through the valve. Specifically, matched, elongated, triangular slots 222 and 224 are formed in valve member 206 and valve casing bottom wall 220, respectively. Slots 222 and 224 are oriented at right angles and so located that, as the valve member is moved along path 208 from right to left as shown in FIG. 4, for example, the two slots will be in registry first at their narrower ends; then at like intermediate locations (one flow aperture thus formed is identified by reference character 226 in FIG. 4); and, finally, at the widest portions of the slots.

The length-to-base ratio of slots 222 and 224 will be 10:1 in a typical application of the present invention. Accordingly, the area of the aperture or orifice through the valve formed by the two slots can be varied by a ratio of 100:1.

Furthermore, the shape of the orifice formed by slots 222 and 224 (a square) remains the same over the entire range of operation of the valve. This keeps the discharge coefficient of the valve constant which also contributes to the successful operation of our novel low emission burners.

Fuel enters valve 189 through line 228 and is metered through the orifice defined by slots 222 and 224 into line 230. From that line it flows through shut-off valve 190 and into the rotating cup injector 98 as discussed above.

A rectangular drain groove 232 is formed in the upper surface of valve casing bottom wall 220. The contact surfaces of the valve member and valve casing will typically be hardened and lapped so that the leakage of fuel between them will be minimal. However, to the extent that leakage does occur, the fuel will drain into groove 232 and from the latter into a communicating groove 234 connected to a drain line 236 through which the fuel can flow back to tank 184 (see FIG. 3).

As indicated above, the fuel metering valve 189 and air metering valve 133 are mechanically coupled so that the relation between the flow areas of these two valves can be precisely controlled over the entire range of operation. This is accomplished by connecting the actuator 210 of the fuel metering valve to air metering and bypass valve actuator 178 and to power lever 176 by pivot pin 177 (see FIGS. 2 and 6).

Because of the novel construction discussed above, the fuel metering valve, like the air metering valve, is linear relative to the power lever. Consequently, adjustment of the power lever from one setting to another will provide a controlled and accurately related change in the flow areas through the two metering valves.

The power lever can be operated by a variety of mechanisms. For example, in Rankine engine applications in which the burner would be employed to supply heat to a vapor generator, the power lever would be positioned by an appropriate engine system actuator as a function of steam pressure and temperature.

Referring now specifically to FIG. 3, the remaining component of our novel low emission burner is the ΔP regulator 187 mentioned briefly above. One function of this component is to keep the ratio of the pressure drops across the fuel and air metering valves constant over the entire range of fuel flows. By regulating the fuel flow in this manner, the fuel:air ratio can, in spite of fluctuations in the pressure drop across the air metering valve not compensated for by the bypass valve arrangement, be reduced to a function of the metering valve flow areas. Accordingly, the ΔP regulator makes an important contribution to maximum efficiency and minimum emissions.

The ΔP regulator includes two pressure responsive diaphragms 246 and 248 mounted in a casing 256 in conventional fashion. The pressure $P_1$ on the upstream side of air metering valve 133 (modified as described later) is applied to the lower side of diaphragm 248 by connecting the interior of casing 256 to plenum chamber 81 by pressure tube 258 (indications of orientation herein are for the sake of convenience and are not intended to limit the scope of protection to which we consider oursevles entitled). The pressure $P_2$ on the downstream side of the air metering valve, which approximates that in combustor 24, is similarly applied to the upper side of diaphragm 248 through tube 260. This generates on diaphragm 248 an upwardly directed force proportional to the pressure drop across the air metering valve.

This force is balanced by that exerted on diaphragm 246. The latter is a result of the difference in combustor pressure (applied to the lower side of diaphragm 246 via tube 260) and the pressure on the upstream side of the fuel metering valve 189 (applied to the upper side of the diaphragm through fuel supply line 228).

Diaphragms 246 and 248 are linked for concomitant movement through equal distances by centering and balancing springs 261 and 262 and by an actuator 263 fixed to diaphragm 246 and extending into engagement with a co-operating disc 264 at the center of diaphragm 248.

Also fixed to the upper diaphragm 246 is the valve member 268 of a fuel flow proportioning valve 270.

The proportioning valve also includes a stationary member 272 fixed in casing 256 in any convenient manner. Member 272 has a hollow bore 273 communicating at one end through the interior of casing 256 with fuel metering valve 189 through fuel line 228 and with fuel tank 184 through fuel line 274. The other end of the bore is connected through bypass line 275 and fuel drain or return line 236 to tank 184. As the pressure in fuel tank 184 is lower than that in casing 256, fuel will flow from the ΔP regulator back to the fuel tank at a rate determined by the proximity of valve member 268 to valve member 272 which controls the inlet area into bore 273.

In the illustrated ΔP regulator:

$$(P_{fuel} - P_2)\,A_2 = (P_1' - P_2)A_1$$

where:

$P_{fuel}$ is the pressure on the inlet side of metering valve 189,

$A_2$ is the area of diaphragm 246,

$A_1$ is the area of diaphragm 248, and $P_1'$ is the pressure on the upstream side of air metering valve 133 with a density correction described later, and $P_2$ is the combustor pressure.

The ratio of the pressure drop across the fuel metering valve 189 ($P_{fuel} - P_2$) to the pressure drop across the air metering valve ($P_1 - P_2$) can accordingly be kept constant by balancing the forces on diaphragms 246 ($P_{fuel} - P_2)A_2$ and 248 ($P_1' - P_2)A_1$. This is done by changing the flow to fuel metering valve 189 to alter $P_{fuel}$ when the pressure drop across the air metering valve ($P_1 - P_2$) changes and the forces become unbalanced. Increased flow increases the pressure drop across the fuel metering valve; reduced flow decreases the pressure drop.

Pump 186 has a fixed delivery volume; and the flow of fuel to the metering valve is accordingly adjusted by repositioning valve member 268 to change the rate at which fuel is bypassed back to tank 184, producing an equal but opposite change in the flow of fuel to fuel metering valve 189.

If the forces become unbalanced by the pressure drop across the air metering valve decreasing, for example, diaphragm 248 will move downwardly and diaphragm 246 will follow. Valve member 268 moves downwardly with diaphragm 246 away from valve member 272. This permits more fuel to flow through valve 270 into bypass line 275. The result is a decrease in the flow of fuel to the fuel metering valve 189 and a drop in $P_{fuel}$. ($P_{fuel} - P_2$) is thereby decreased to compensate for the decrease in pressure across the air metering valve, keeping the weight flows of fuel and air in the wanted ratio.

The operation is comparable, but reversed, when the pressure differential across the air metering valve increases.

The force balance set forth above shows that the pressure drop across fuel metering valve 189 is a function of the ratio of the areas of diaphragms 246 and 248 once the pressure drop across air metering valve 133 is selected. In a typical application of our invention these diaphragms will be dimensioned so the nominal pressure drop across the fuel metering valve will be on the order of 10 psig.

It is a second function of the illustrated ΔP regulator 187 to introduce a correction for the density of the combustion air so that high efficiency and low emissions will be maintained under changes in altitude and ambient temperatures. A correction of this character will not be required in all applications of our invention. In those in which it is not, the components employed to provide the correction may be omitted.

In the embodiment of the invention illustrated in FIG. 3, the density correction is made in the $P_1$ signal applied to the bottom of diaphragm 248 as indicated above. The mechanism for making the correction includes a third, pressure responsive diaphragm 276 mounted in the bottom of casing 256 and a contoured, variable area valve 277 mounted on the diaphragm and extending through an orifice 278 in a transverse casing partition 279. A conventional centering and balancing spring 280 extends between the diaphragm and partition.

Air is trapped in a cavity 282 between diaphragm 276 and the lower wall 284 of the casing. Variations in altitude or ambient temperature cause the trapped air to expand or contract, moving diaphragm 276 and valve 277 upwardly or downwardly to decrease or increase the flow area through the orifice.

The density correction mechanism also includes a tube 288 connected between the lower side of diaphragm 248 and the $P_2$ pressure tube or tap 260. A fixed area orifice 290 is mounted in this tube.

The air at pressure $P_1$ flows from the upstream side of air metering valve 133 to the side of variable orifice 278 opposite diaphragm 248, through the orifice, into tube 288, and through orifice 290 into tube 260. This corrects the pressure applied to the lower side of diaphragm 248 for variations in the density of the combustion air in accord with the formula:

$$P_1' - P_2 = \left[\frac{1}{\left(\frac{A_o}{A_n}\right)^2 + 1}\right](P_1 - P_2)$$

where:

$A_o$ is the area of fixed orifice 290, and $A_n$ is the flow area through variable orifice 278.

It can be readily shown that the correction factor thus obtained will be proportional to deviations from a standard density if valve 277 is so dimensioned that:

$$A_n = A_o \sqrt{\frac{1}{\frac{A_D}{K'a\,R}(y-1)}}$$

where:

$A_D$ is the area of sealed cavity 282, y is the depth of cavity 282 (this parameter varies with changes in altitude and ambient temperature as these result in expansion and contraction of trapped air and movement of diaphragm 276), K′ is the discharge coefficient through orifice 278, a is the weight of the trapped air, and R is the gas constant for air.

To illustrate the operation of the density compensator mechanism, if the ambient temperature adjacent cavity 282 increases, for example, the weight flow of combustion air to combustor 24 may decrease, even though the pressure drop across the air metering valve does not change. This will lower the air-fuel ratio and make the combustible mixture too rich unless the flow of fuel to and the pressure across the fuel metering valve is reduced to reflect the lower density of the warmer air. The density compensator effects the necessary decrease in the pressure drop across the fuel metering valve.

Specifically, as the ambient temperature increases, the air trapped in sealed cavity 282 expands, moving diaphragm 276 and contoured valve 277 upwardly to decrease the flow area through variable orifice 278. The pressure drop across the orifice ($P_1 - P_1'$) therefore increases; and a lower pressure $P_1'$ is applied to the lower side of diaphragm 248. Consequently, the difference between $P_2$ and $P_1'$ decreases; diaphragms 248 and 246 and valve member 268 move downwardly; and fuel is bypassed to tank 184 at an increased rate. This decreases the pressure drop across the fuel metering valve and, therefore, the mass flow of fuel to the combustor to compensate for the lower mass flow of air.

The operation of the density compensation mechanism is comparable when the density change is due to a decrease in temperature or a change in altitude (i.e., ambient pressure).

The density compensator can be recalibrated, as necessary, by removing the plug 292 in the bottom of casing 256, displacing valve 277 to the position appropriate for the existing ambient temperature and altitude, and replacing the plug.

Our invention may be embodied in other specific forms and may be employed in applications other than those expressly identified above without departing from the spirit or essential characteristics thereof. The present embodiment and representative applications are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A low emission burner comprising: a combustor, means for injecting a liquid fuel in spray form into one end of the combustor; air inlet means having a plurality of apertures therethrough located adjacent said end of said combustor; means for supplying air to said combustor and for effecting a flow of combustion air through said apertures and into said combustor; a valve member rotatably mounted adjacent said air inlet means and having therethrough apertures corresponding to the apertures through said air inlet means; means for rotating the valve member relative to said air inlet means to vary the area through which air can flow to the combustor as the demand upon the burner changes; an air bypass means for diverting air supplied as aforesaid from said combustor; means for adjusting the flow area through said bypass means; and means so mechanically connecting said flow area adjusting means to said valve member that, as said valve member is rotated to decrease the area through which air can flow to the combustor, air is automatically diverted through said bypass means at an extent which will tend to keep the pressure drop across the valve member and the air inlet means essentially unchanged.

2. The combination of a combustor; means including first and second metering valves for supplying regulated flows of fuel and air to said combustor, said first and second metering valves each including a first apertured member through which a fluid can flow to the combustor, a second apertured member for varying the area of flow through the first member, and means mounting each said second member adjacent the associated first member for movement relative thereto, the apertures in the first and second members of said first metering valve being elongated slots which vary in width from end-to-end and the mounting means for said valve accommodating registration of said slots over substantially the entire length thereof, whereby the flow area through said metering valve can be varied over a range corresponding to the product of the length-to-width ratios of the slots; and means mechanically coupling the second members of the two metering valves so that they move in unison and thereby keep the areas of flow through the two metering valves in a selected relationship over the range of operation of said valves.

3. The combination of claim 2 together with means for draining from said fuel metering valve fuel leaking between said first and second members.

4. The combination of claim 2 wherein said slots are of matched configuration and so disposed relative to each other that the shape of the opening formed by the two members remains substantially constant over the entire range of flow areas.

5. The combination of a combustor; means including first and second metering valves for supplying regulated flows of fuel and air to said combustor, said first and second metering valves each including a first apertured member through which a fluid can flow to the combustor, a second apertured member for varying the area of flow through the first member, and means mounting each said second member adjacent the associated first member for movement relative thereto; and means mechanically coupling the second members of the two metering valves so that they move in unison and keep the areas of flow through the two metering valves in a selected relationship over the range of operation of said valves, the means for supplying air to the combustor also comprising a bypass valve through which air can be diverted from said second metering valve to keep the pressure drop across said valve from increasing as the flow area through said valve is decreased.

6. The combination of a combustor; means comprising a first metering valve for supplying a regulated flow of fuel to said combustor; means comprising a second metering valve for supplying a regulated flow of air to said combustor; means so mechanically connecting said first and second metering valves that the fuel and air flow areas are kept in a selected relationship over the entire range of operation of said valves; and means for keeping the weight ratio of the fuel and air flowing to the combustor a function of the fuel and air flow areas, said last-mentioned means comprising means for proportioning the pressure drop across the metering valve to that across the second metering valve and fuel flow regulating means including: a variable flow valve; means connecting the inlet side of said valve to said first, fuel metering valve and to a fuel supply; a fuel bypass means connected to the outlet side of said fuel metering valve; a first pressure responsive diaphragm; means for applying pressures indicative of those existing on the upstream and downstream sides of said second, air flow metering valve to opposite sides of said diaphragm; a second diaphragm in series with said first-mentioned diaphragm; means for applying pressures existing on opposite sides of said first, fuel metering valve to said second diaphragm; means so connecting said first and second diaphragms that the change in the forces on said diaphragms will result in a movement of said diaphragms; and means for so transmitting the movement of said diaphragms to said variable flow valve that the flow of fuel to said bypass means and to said first metering valve will be reproportioned by said valve and the pressure drop across the first, fuel metering valve thereby adjusted to compensate for the change in the pressure drop across the second metering valve.

7. The combination of a combustor; means comprising a first metering valve for supplying a regulated flow of fuel to said combustor; means comprising a second metering valve for supplying a regulated flow of air to said combustor; means so mechanically connecting said first and second metering valves that the fuel and air flow areas are kept in a selected relationship over the entire range of operation of said valves; means for proportioning the pressure drop across the first metering valve to that across the second metering valve and thereby insuring that the weight ratio of fuel and air supplied to the combustor remains a function of the fuel and air flow areas; and means for so varying the flow of fuel to the combustor as to compensate for variations in the density of the air supplied thereto.

8. The combination of claim 7 wherein the means for compensating for variations in the density of the air supplied to the combustor comprises a fuel bypass valve upstream and in series with said first, fuel metering valve; a bypass means connected to one side of said valve; means connecting the opposite side of said valve to said fuel metering valve; a pressure responsive diaphragm; means for transmitting movement of said diaphragm to said bypass valve and thereby causing said valve to reproportion the flow of fuel between said fuel metering valve and said bypass means; means for applying the pressure existing on one side of said second, air metering valve to one side of said diaphragm; an adjustable orifice means; means for effecting a flow of air from the other side of said second metering valve to the other side of said diaphragm through said variable orifice means, whereby said diaphragm will be displaced and the flow of fuel reproportioned as aforesaid as the pressure drop across the air metering valve changes; and means for so adjusting the flow area through the orifice in proportion to changes in the density of the air supplied to the combustor as to make the pressure drop of the air flowing through the orifice and applied to said other side of the diaphragm indicative of the difference between the actual density of the air and a reference density.

9. The combination of claim 8 wherein said adjustable orifice means comprises a member having an aperture therethrough; a second pressure responsive diaphragm; a variable area valve member movable with said second diaphragm and relative to the apertured member to vary the flow area therethrough, said air flow effecting means communicating with one side of said second diaphragm on the side of the apertured member opposite the first diaphragm, and said density compensating means further includes means providing a trapped body of air on the opposite side of said second diaphragm from said air flow effecting means whereby, as said air expands and contracts and its density changes, said variable area valve is repositioned to reflect the change in density by varying the flow area through the apertured member and the pressure drop thereacross of the air flowing to said other side of said first diaphragm.

10. The combination of a combustor; means including first and second metering valves for supplying regulated flows of fuel and air to said combustor, said first and second metering valves each including a first apertured member through which a fluid can flow to the combustor, a second apertured member for varying the area of flow through the first member, and means mounting each said second member adjacent the associated first member for movement relative thereto; and means mechanically coupling the second members of the two metering valves so that they move in unison and keep the areas of flow through the two metering valves in a selected relationship over the range of operation of said valves.

11. The combination of a combustor; means comprising a first metering valve for supplying a regulated flow of fuel to said combustor; means comprising a second metering valve for supplying a regulated flow of air to said combustor; means so mechanically connecting said first and second metering valves that the fuel and air flow areas are kept in a selected relationship over the entire range of operation of said valves; and means for proportioning the pressure drop across the first metering valve to that across the second metering valve and thereby insuring that the weight ratio of fuel and air supplied to the combustor remains a function of the fuel and air flow areas.

* * * * *